US005977697A

United States Patent [19]

Jin et al.

[11] Patent Number: 5,977,697

[45] Date of Patent: Nov. 2, 1999

[54] FIELD EMISSION DEVICES EMPLOYING DIAMOND PARTICLE EMITTERS

[75] Inventors: Sungho Jin, Millington; Gregory Peter Kochanski, Dunellen; Wei Zhu, Warren, all of N.J.

[73] Assignee: Lucent Technologies Inc., Murray Hill, N.J.

[21] Appl. No.: 09/006,347

[22] Filed: Jan. 13, 1998

Related U.S. Application Data

[63] Continuation-in-part of application No. 08/361,616, Dec. 22, 1994, Pat. No. 5,709,577.

[51] Int. Cl.[6] ..... H01J 1/30

[52] U.S. Cl. ..... 313/310; 313/311; 445/51

[58] Field of Search ..... 445/24, 51; 313/495–497, 313/310, 311

[56] References Cited

U.S. PATENT DOCUMENTS

| | | | |
|---|---|---|---|
| 4,490,916 | 1/1985 | Borel et al. | 313/306 |
| 5,129,850 | 7/1992 | Kane et al. | 448/24 |
| 5,138,237 | 8/1992 | Kane et al. | 315/349 |
| 5,242,711 | 9/1993 | DeNatale et al. | 427/249 |
| 5,283,500 | 2/1994 | Kochanski | 315/58 |
| 5,504,385 | 4/1996 | Jin et al. | 313/310 |
| 5,623,180 | 4/1997 | Jin et al. | 313/310 |
| 5,637,950 | 6/1997 | Jin et al. | 313/310 |
| 5,686,791 | 11/1997 | Kumar et al. | 313/495 |

OTHER PUBLICATIONS

"Vacuum Microelectronics", by Hawkes, P. W., *Advances in Electronics and Electron Physics*, vol. 83, Academic Press Inc., pp. 75–107 (1992).

"Cold Cathode Field Emission Array", by Castellano, J. A., *Handbook of Display Technology*, Academic Press Inc., pp. 254–257 (1992).

"Field–Emitter Arrays for Vacuum Microelectronics", by Spindt, C. A. et al., *IEEE Transactions on Electron Devices*, vol. 38, No. 10, pp. 2355–2363 (Oct. 1991).

"Defect–Enhanced Electron Field Emission from Chemical Vapor Deposited Diamond", by Zhu, W. et al., *J. Appl. Phys.*, 78 (4), pp. 2707–2711 (Aug. 15, 1995).

"Fabrication of a Diamond Field Emitter Array", by Okano, K. et al., *Appl. Phys. Lett.*, 64 (20), pp. 2742–2744 (May 16, 1994).

*Primary Examiner*—Kenneth J. Ramsey
*Attorney, Agent, or Firm*—Scott J. Rittman

[57] ABSTRACT

Improved diamond particle emitters, useful for flat panel displays, are fabricated by suspending nanometer-sized ultra-fine particles in a solution, applying the suspension as a coating onto a conducting substrate such as n-type Si or metal, subjecting the coated substrate to a plasma of hydrogen, and applying a thin, conformal diamond over-coating layer onto the particles. The resulting emitters show excellent emission properties, such as extremely low turn-on voltage, good uniformity and high current densities. In particular, the electron emitters are capable of producing electron emission current densities of at least 0.1 mA/,mm$^2$ at extremely low vacuum electric fields of 0.2–3.0 V/$\mu$m V/$\mu$m. These field values are about an order of magnitude lower than exhibited by the best defective CVD diamond and almost two orders of magnitude lower than p-type semiconducting diamond. It is further found that the emission characteristics remain the same even after the plasma treated diamond surface is exposed to air for several months.

27 Claims, 3 Drawing Sheets

#74 125kx

#73 125kx

FIELD EMISSION DEVICES EMPLOYING DIAMOND PARTICLE EMITTERS

This application is a continuation-in-part of U.S. patent application Ser. No. 08/361,616, filed Dec. 22, 1994 (our reference Jin-Kochanski-Zhu 94-16-4), now U.S. Pat. No. 5,709,577 the disclosure of which is hereby incorporated by reference.

FIELD OF THE INVENTION

This invention pertains to field emission devices, in particular field emission devices such as flat panel displays that use ultra-fine diamond particle emitters.

BACKGROUND OF THE INVENTION

Currently, a promising source of electrons in vacuum devices is field emission of electrons into vacuum from suitable cathode materials. These vacuum devices include flat panel displays, klystrons and traveling wave tubes used in microwave power amplifiers, ion guns, electron beam lithography, high energy accelerators, free electron lasers, and electron microscopes and microprobes. The most promising application is the use of field emitters in matrix-addressed flat panel displays. See, for example, *Semiconductor International*, December 1991, p. 46; C. A. Spindt et al., *IEEE Transactions on Electron Devices*, Vol. 38, p. 2355 (1991); I. Brodie and C. A. Spindt, *Advances in Electronics and Electron Physics*, edited by P. W. Hawkes, Vol. 83, pp. 75–87 (1992); and J. A. Costellano, *Handbook of Display Technology*, Academic Press, New York, pp. 254 (1992), the disclosures of which are hereby incorporated by reference.

A typical field emission device comprises a cathode containing a plurality of field emitter tips and an anode spaced from the cathode. A voltage applied between the anode and cathode induces the emission of electrons towards the anode. A conventional electron field emission flat panel display comprises a flat vacuum cell, the vacuum cell having a matrix array of microscopic field emitters formed on a cathode and a phosphor coated anode on a transparent front plate. Between cathode and anode is a conductive element called a grid or gate. The cathodes and gates are typically intersecting strips (usually perpendicular strips) whose intersections define pixels for the display. A given pixel is activated by applying voltage between the cathode conductor strip and the gate conductor. A more positive voltage is applied to the anode in order to impart a relatively high energy (400–3,000 eV) to the emitted electrons. See, for example, U.S. Pat. Nos. 4,940,916; 5,129,850; 5,138,237 and 5,283,500, the disclosures of which are hereby incorporated by reference.

A variety of characteristics are known to be advantageous for cathode materials of field emission devices. The emission current is advantageously voltage controllable, with driver voltages in a range obtainable from off-the-shelf integrated circuits. For typical device dimensions (e.g., 1 $\mu$m gate-to-cathode spacing), a cathode that emits at fields of 25 V/$\mu$m or less is generally desirable for typical CMOS circuitry. The emitting current density is advantageously in the range 0.1–1 mA/mm$^2$ for flat panel display applications. The emission characteristics are advantageously reproducible from one source to another, and advantageously stable over a very long period of time (tens of thousands of hours). The emission fluctuations (noise) are advantageously small enough to avoid limiting device performance. The cathode is advantageously resistant to unwanted occurrences in the vacuum environment, such as ion bombardment, chemical reaction with residual gases, temperature extremes, and arcing. Finally, the cathode manufacturing is advantageously inexpensive, e.g., no highly critical processes, and adaptable to a wide variety of applications.

Previous electron emitters were typically made of metal (such as Mo) or semiconductor material (such as Si) in nanometer sizes. While useful emission characteristics have been demonstrated for these materials, the control voltage required for emission is relatively high (around 100 V) because of the materials' high work functions. The high voltage operation increases damage caused by ion bombardment and surface diffusion on the emitter tips. High voltage operation also necessitates high power densities to be supplied from an external source to produce the required emission current density. In addition, the fabrication of uniform sharp tips is difficult, tedious and expensive, especially over a large area. The vulnerability of these materials to ion bombardment, chemically active species and temperature extremes is also a serious concern.

Diamond is a useful material for field emitters because of its negative electron affinity and robust mechanical and chemical properties. Field emission devices employing diamond field emitters are disclosed, for example, in U.S. Pat. Nos. 5,129,850 and 5,138,237 and in Okano et al., *Appl Phys. Lett.*, Vol. 64, p. 2742 (1994), the disclosures of which are hereby incorporated by reference. Flat panel displays that employ diamond emitters are disclosed in co-pending U.S. patent application Ser. No. 08/567,867 (our reference Eom 5-118-32-28-26), now U.S. Pat. No. 5,747,918 08/548,720 (our reference Jin 116-30-1), U.S. Pat. No. 5,504,385, U.S. Pat. No. 5,637,950 and U.S. Pat. No. 5,623,180, the disclosures of which are hereby incorporated by reference.

While diamond offers substantial advantages for field emitters, there is a need for diamond emitters capable of emission at yet lower voltages. For example, flat panel displays typically require current densities of at least 0.1 mA/mm$^2$. If such densities are achieved with an applied voltage below 25 V/$\mu$m for the gap between the emitters and the gate, it will be possible for low cost CMOS driver circuitry to be used in the display. Unfortunately, good quality, intrinsic diamond generally does not emit electrons in a stable fashion because of diamond's insulating nature. Therefore, to effectively take advantage of the negative electron affinity of diamond in order to achieve low voltage emission, diamonds need to be conventionally doped into n-type semiconductivity. The n-type doping process, however, has not been reliably achieved for diamond. While p-type semiconducting diamond is readily available, p-doped diamond is not helpful for low voltage emission because the energy levels filled with electrons are far below the vacuum level. For example, a field of more than 70 V/$\mu$m is needed for p-type semiconducting diamond to generate an emission current density of 0.1 mA/mm$^2$. (See, e.g., Zhu et al., *J. Appl. Phys.,* 78, 2707, 1995.)

An alternative method to achieve low voltage field emission from diamond is to grow or treat diamond so that the densities of defects are increased in the diamond structure, as disclosed in U.S. Pat. No. 5,637,950. Such defect-rich diamond typically exhibits a full width at half maximum (FWHM) of 7–11 cm$^{-1}$ for the diamond peak at 1332 cm$^{-1}$ in Raman spectroscopy, and it is possible for the electric field required to produce an electron emission current density of 0.1 mA/mm$^2$ from these diamonds to reach as low as 12 V/$\mu$m.

Thus, further improved diamond emitter devices, and improved methods for making such devices, are desired, particularly for flat panel displays.

SUMMARY OF THE INVENTION

The invention is a method for making improved electron field emitters, and the resultant emitter structures, using commercially available diamond particles that are treated to enhance their capability for electron emission under extremely low electric fields. Specifically, electron emitters containing ultra-fine (e.g., 5–10,000 nm maximum dimensions) diamond particles heat-treated by a hydrogen plasma and provided with an additional conformal diamond overcoating produce electron emission current density of at least 0.1 mA/mm$^2$ at extremely low vacuum electric fields of 0.2–3.0 V/$\mu$m. In fact, it is possible for the current density to reach as high as 0.3 mA/mm$^2$ before breakdown of the emitter occurs, which is more than twice as high as the current density achieved for diamond particles without the conformal overcoating. These field values are as much as an order of magnitude lower than exhibited by the best defective CVD diamond and as much as two orders of magnitude lower than p-type diamond.

In one embodiment, emitters are fabricated by suspending the ultra-fine diamond particles in an aqueous solution, applying the suspension as a coating onto a conducting substrate such as n-type conductive Si or metal, subjecting the coated substrate to a plasma of hydrogen, and applying a conformal overcoating of diamond on the plasma treated particles. (It is possible for the steps of applying the suspension and plasma treating to be reversed.) Advantageously, the diamond particles have a maximum dimension of 5 to 10,000 nm, and the conformal diamond overcoating has a thickness less than 30 nm. The plasma treatment is advantageously performed at a temperature above 300° C., for a time period of 30 minutes or longer. The resulting emitters show excellent emission properties such as extremely low turn-on voltage, good uniformity and high current densities. In addition, the emission characteristics remain essentially the same even after the overcoated diamond surface is exposed to air for several months.

DETAILED DESCRIPTION OF THE INVENTION

Figure 1:
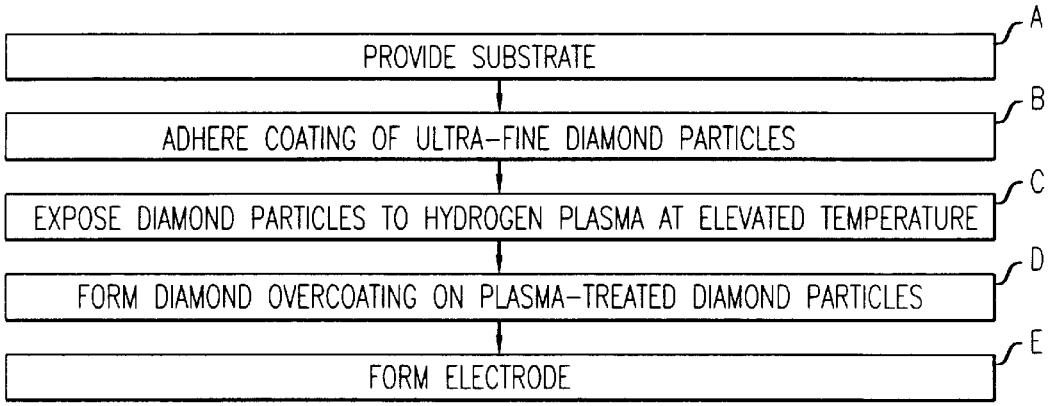
FIG. 1 is a flow diagram of one embodiment of the process of the invention.

FIG. 1 illustrates one embodiment for preparing a field emitter structure according to the invention. The first step shown in block A of FIG. 1 is to provide a substrate. The substrate is metal, semiconductor or a conductive oxide. It is also possible for the substrate to be insulating if a conductive material is applied to the surface. For many substrates, especially oxides, it is advantageous, before diamond deposition, to deposit a protective layer of a material that is not readily etched by hydrogen plasma. For example, a layer of 100 nm or less of silicon typically prevent reactions between hydrogen and the oxide substrate during the hydrogen plasma treatment.

The next step shown in block B is to adhere to the substrate a thin coating of ultra-fine diamond particles, advantageously having maximum dimensions of 5 to 10,000 nm, more advantageously 10 to 300 nm. Ultra-fine diamond particles are useful because of their emission voltage-lowering defects, and because the small radius of curvature tends to concentrate the electric field. In addition, small dimensions reduce the path length which electrons must travel in the diamond and simplify construction of the emitter-gate structure. Particles of this size are commercially available. For example, a high temperature, high pressure synthesis technique (explosive technique) is used by E. I. Dupont to manufacture nanometer diamond particles sold under the product name Mypolex. It is also possible to prepare the diamond particles by low pressure chemical vapor deposition, precipitation from a supersaturated solution, or by mechanical or shock-induced pulverization of large diamond particles. The diamonds are desirably uniform in size, and, advantageously, 90 vol.% have maximum dimensions between ⅓ the average and 3 times the average.

One method for coating the substrate is to suspend the diamond particles in a carrier liquid and apply the mixture to the substrate. The diamond particles are advantageously suspended in water or other liquid such as alcohol or acetone (and optionally with charged surface adherent surfactants) in order to avoid agglomeration of fine particles and for easy application on flat substrate surfaces. The suspension permits application of relatively thin, uniform coatings of diamond particles in a convenient manner such as by spray coating, spin coating, sol gel method, or electrophoresis. The coating advantageously has a thickness less than 10 $\mu$m, more advantageously less than 1 $\mu$m. Even more advantageously, there is only one layer of particles on the substrate, such that the diamond covers 1% to 90% of the surface.

It is desirable to reduce the thermal expansion mismatch between the diamond particles and the conductive substrate for the sake of adhesion between the two. Typically, the two thermal expansion coefficients are within a factor of 10, and advantageously less than a factor of 6. For substrates whose thermal expansion substantially differs from diamond (e.g. glass or tantalum) it is advantageous for the deposited film to be less than three times the thickness of a monolayer (monolayer being a single layer of diamond particles) and more advantageously to be a single monolayer with 1% to 90% coverage. The emitter layer and/or the surface of the conductive substrate are typically patterned into a desirable emitter structure, e.g., a pattern of rows or columns, such that emission occurs only from the desired regions. The carrier liquid is typically allowed to evaporate or to burn off during subsequent plasma processing.

Instead of suspension in a carrier liquid, it is also possible for the ultra-fine diamond particles to be mixed with conductive particles, such as elemental metals or alloys (e.g., solder), together with solvents and optionally binders (which are pyrolized later) to form a slurry. In such a case, it is possible for the substrate to be non-conductive and for the mixture to be screen printed or dispersed onto the substrate to form a desired emitter pattern. Where solder particles are used, particularly solders having relatively low melting temperature, e.g., Sn, In, Sn—In, Sn—Bi, or Pb—Sn, the solder is typically melted subsequent to application of the suspension to further enhance the adhesion of the diamond particles and allow easy electrical conduction to the emitter tips. Alternatively, instead of using a suspension or a slurry, it is possible for dry diamond particles to be placed in the surface of a conductor-covered substrate by electrostatic deposition, by electrophoresis or by sprinkling. The diamond particles are then secured to the surface either by physical embedding into soft conductor layers or by chemical bonding onto the conductor.

If a conductor layer is deposited on the substrate, the conductive layer is either metallic or semiconducting. It is advantageous, for improved adhesion of the diamond particles, to make the conductive layer with materials containing carbide-forming elements or their combinations, e.g., Si, Mo, W, Nb, Ti, Ta, Cr, Zr, or Hf. Alloys of these elements with high electrical conductivity metals such as copper are also advantageous. It is possible for the conductive layer to consist of multiple layers or steps.

Optionally, to improve the uniformity of emission, it is possible for portions of the conductive layer away from the high-conductivity diamond particle-substrate interface to be etched away or otherwise treated to increase the impedance of these portions. Depending on the specific materials and processing conditions, it is possible for field emitters to be undesirably non-uniform with pixel-to-pixel variation in display quality. In order to improve display uniformity, it is useful to add electrical impedance in series with each pixel and/or each emitter, thus limiting the emission current from the best field emitting particles. This permits other emitter sites to share in the emission and provides a more uniform display. Typical resistivity of the uppermost continuous conductive surface on which the ultra-fine diamond emitters are adhered is at least 1 mΩ-cm and advantageously at least 1 Ω-cm. The resistivity is advantageously less than 10 KΩ-cm. In terms of surface resistivity, when measured on a scale greater than the inter-particle distance, the conductive surface advantageously has surface resistance greater than 1 MΩ/square and more advantageously greater than 100 MΩ/square.

The third step of this embodiment, shown in block C of FIG. 1, is to activate the diamond particles by exposing them to hydrogen plasma. One to manner of doing so is to place the coated substrates (after drying, if necessary) into a vacuum chamber for treatment with hydrogen plasma at elevated temperature. The plasma predominantly contains hydrogen, but it is possible to include a small amount of other elements, for example, carbon at less than 0.5 atomic percent, advantageously less than 0.1 atomic percent. The substrates are typically exposed to the plasma at a temperature in excess of 300° C., advantageously in excess of 400° C., and more advantageously in excess of 500° C., for a period sufficient to produce a device having an electron emission current density of at least 0.1 $mA/mm^2$ at a field strength below 12 V/μm. This period typically exceeds 30 minutes at a temperature of about 300° C., and at a diamond coating thickness less than 1 μm, but it is possible for the time to be less than 30 minutes for higher temperatures and/or thinner films. A control sample is easily utilized to determine appropriate treatment for a desired set of parameters.

While the exact role of the plasma treatment is not completely understood, it is believed that the hydrogen plasma cleans the diamond surface by removing carbonaceous and oxygen or nitrogen related contaminants, and also introduces hydrogen-terminated diamond surfaces with low or negative electron affinity. The hydrogen plasma also removes any graphite or amorphous carbon phases present on the surface and along the grain boundaries. In addition, treatment improves contacts among the particles and between the particles and the substrate, thus increasing the bulk as well as the surface conductivity. Such conductive contacts are important in sustaining a stable electron emission process. The structure of the nanometer diamond particles is believed to be defective containing various types of bulk structural defects such as vacancies, dislocations, stacking faults, twins and impurities such as graphitic or amorphous carbon phases. It is believed that when the concentrations of these defects are high, it is possible for the defects to form energy bands within the bandgap that contributes to the electron emission at low electrical fields.

Figure 2:
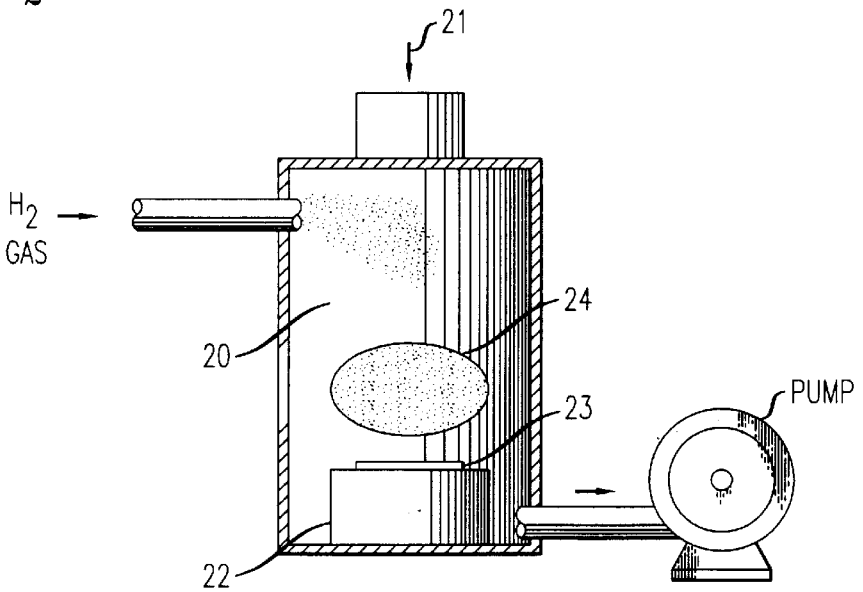
FIG. 2 is a schematic diagram of apparatus useful in the process of the invention.
Figure 4A:
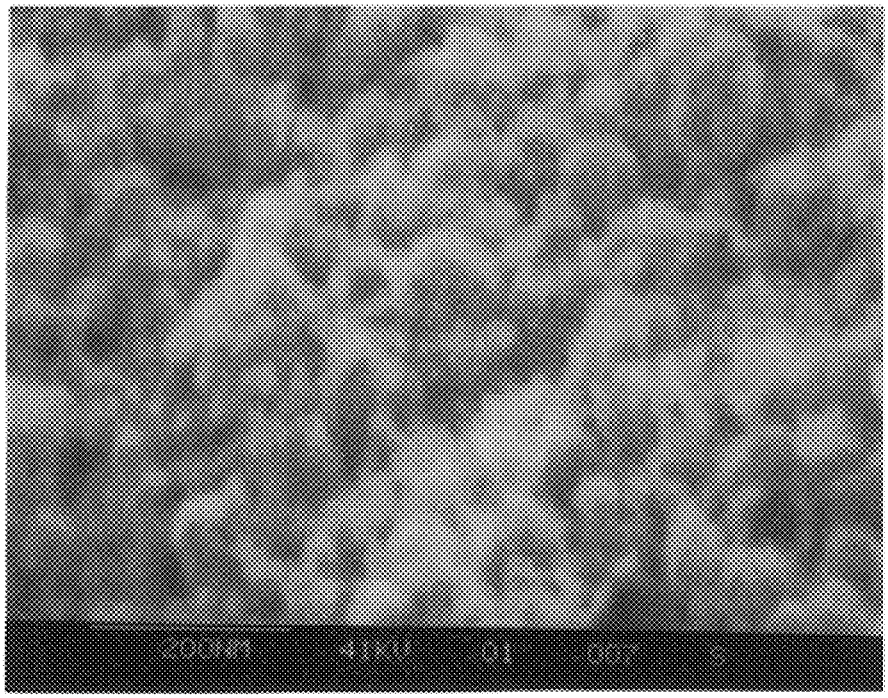
FIGS. 4A and 4B are scanning electron micrographs (SEMs) of a diamond emitter structure formed without and with, respectively, the conformal diamond overcoating.

FIG. 2 schematically illustrates an apparatus useful for activating the diamond particles. The apparatus contains a vacuum chamber 20 equipped with a microwave source 21 and a heater 22. The coated substrate 23 is typically placed on the heater 22. A hydrogen or hydrogen-containing plasma 24 is ignited by the microwave energy and forms above the substrate. The substrate temperature is advantageously kept above 300° C. for process kinetics and efficiency, but advantageously below 1,000° C. for convenience. The typical plasma parameters include a microwave power input of 1 kW and a pressure of 10–100 torr. The duration of such a heat treatment is typically in the range of 1 min. to 100 hours, advantageously 10 minutes to 12 hours, depending on the temperature and thickness of the diamond film. FIG. 4A is an SEM of the emitter structure subsequent to activation of the particles.

It is possible for the microwave plasma to be replaced by a plasma or arc excited by radio frequency (rf) or direct current (dc). Other means of creating a source of activated atomic hydrogen are also possible, such as using hot filaments of tungsten or tantalum heated to above 2,000° C., rf or dc plasma torch or jet, and combustion flame.

The fourth step of this embodiment, shown as Block D in FIG. 1, is to apply a conformal overcoating of diamond film on the plasma treated diamond particles, typically by chemical vapor deposition. Following the hydrogen plasma heat treatment, the treated diamond particles are exposed to a plasma containing a mixture of hydrogen and a carbon-containing compound to deposit a conformal diamond film on the particles. The carbon-containing compound is typically methane gas, but other gases and liquids are also possible, e.g., ethane, alcohol, acetone, CO, $CO_2$, and acetylene. (Where a liquid carbon-containing compound is used, an inert gas is typically bubbled through the liquid compound to promote introduction of vapor of the compound into the plasma.) Treatment by the carbon-containing plasma causes growth of additional diamond onto the surfaces of the diamond particles, thereby forming a conformal film over the particles. Growth of the conformal overcoating advantageously proceeds in an epitaxial fashion, so that the structure of the diamond overcoating is a direct extension of the surface structure of the diamond particles. In this manner, the characteristic structure of the diamond particles that is responsible for useful emission properties is largely preserved in the structure of the diamond overcoating. The overcoating thickness should be enough to ensure a conformal layer, but not so thick that the continuation of the defective particle structure is lost. The thickness is typically 1 to 50 nm, and advantageously less than 30 nm. The atomic ratio of carbon to hydrogen is advantageously about 0.1% to about 10%. Where methane gas is used for the overcoating process, the methane concentration in hydrogen is advantageously 0.1 to 10 mole percent, more advantageously 0.5–5 mole percent.

Figure 3:
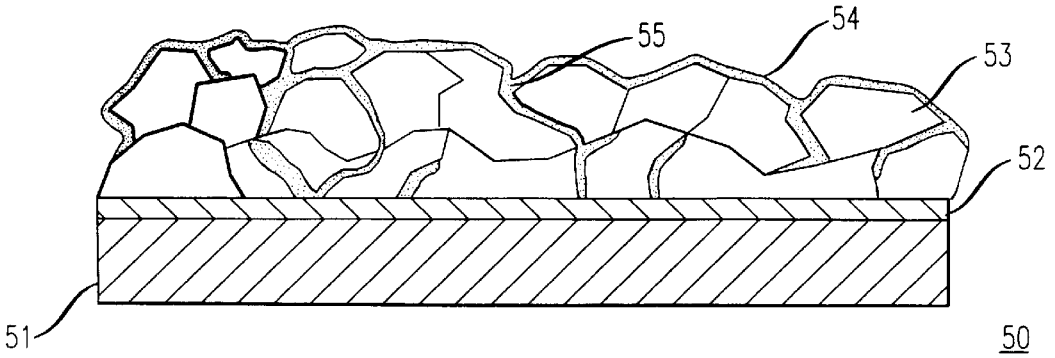
FIG. 3 illustrates a schematic structure formed according to one embodiment of the process of the invention.

FIG. 3 is a schematic illustration of a two-dimensional cross-section of a three-dimensional emitter structure 50 formed after the diamond overcoating step. The emitter structure 50 contains a substrate 51 containing a conductive layer 52. Diamond emitter particles 53 are adhered to the conductive layer 52. A conformal overcoating 54 is formed on the surface of the emitter particles 53. Typically, the diamond overcoating step will also result in formation of an internal conformal coating 55 at interior interfaces of the diamond particles 53, due to the infiltration of the reactive species. This internal conformal coating 55 increases the particle-to-particle bonding as well as particle-to-substrate interfacial bonding. The increased bonding improves both the surface and bulk electrical conductivity, thereby assisting the electron transport through the emitter structure, such transport being necessary for sustained and stable electron emission operation. In fact, according to four-point probe resistance measurements reflected in the Example, the conductivity of the ultra-fine diamond particles with the overcoating is generally at least 2–10 times higher than that of the particles without the overcoating. Typically, the electrical conductivity of the emitter structure will be at least 20% higher than an identical structure without the diamond overcoating, advantageously at least 50% higher.

Figure 4B:
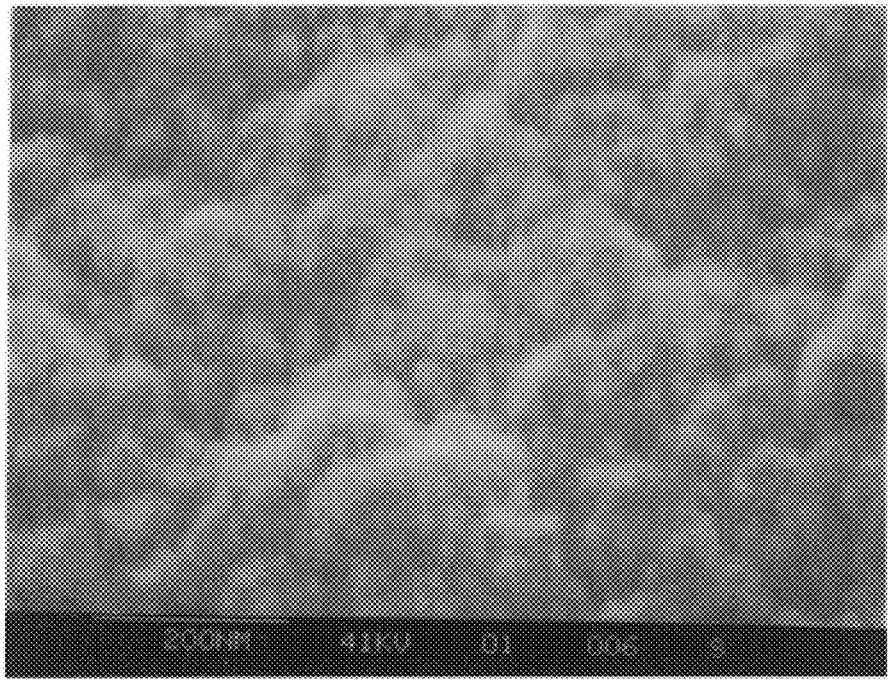

As can be seen from FIG. 4B, which is an SEM of the surface morphology of the overcoated emitter structure, the overcoating conformably and uniformly covers the particle surfaces, and also reduces both geometrical irregularities and chemical contamination differences from particle to particle of the structure shown in FIG. 4A. These geometrical and chemical contamination differences among the individual particles are the source of frequently observed "hot" emitting spots or emission non-uniformity which often lead to premature emitter failure. The overcoated emitter layer provides a more homogenous surface with increased bonding and conductivity, all of which appear to directly contribute to enhanced emission properties, e.g., higher emission current densities and lower emission threshold fields with higher emission site densities. The emission uniformity is important to practical device applications since the occurrence of hot emitting spots tends to cause premature failure of the emitter structure. The emission uniformity also allows high emission currents to be achieved at relatively low fields without causing hot spots or premature emitter failure to occur, because there are more active emission sites in a given area which contribute to the overall current. Diamond particle emitters with the overcoating layer typically produce an emission site density at least 100% higher, advantageously at least 300% higher, than diamond particle emitters without the thin overcoating layer. The emitter structure with the overcoating typically exhibits a threshold field, at an electron emission current density of 0.1 $mA/mm^2$, at least 20% lower than an identical emitter structure without the conformal diamond overcoating, advantageously at least at least 50% lower than an identical emitter structure without the conformal diamond overcoating. The emitter structure also typically exhibits an emission current density at least 30% higher than an identical emitter structure without the conformal diamond overcoating, advantageously at least 100% higher, at a field strength below 12V/$\mu$m.

The process of depositing the conformal diamond overcoating is performed either in the same apparatus as used for the hydrogen plasma heat treatment or in a different deposition system. Where the same apparatus is used it is possible to start the overcoating deposition process immediately following the hydrogen plasma heat treatment, without the need to switch off the hydrogen plasma or move the samples. The carbon-containing compound is simply mixed with hydrogen as the input gas and the mixture is introduced into the chamber. The overcoating process is typically performed at a temperature above 300° C., advantageously above 400° C. and more advantageously above 500° C., for deposition kinetics. The typical deposition conditions in the apparatus of FIG. 2 are a microwave input power of 1 kW and a pressure of 10 to 100 torr. The duration of the deposition process is typically 0.5 min. to 5 hours and advantageously 1 min. to 1 hour, depending on the deposition parameters and the thickness desired. As in the plasma heat treating process, it is possible for the microwave plasma of the hydrogen and carbon-containing compound to be replaced by a plasma or arc generated by means of radio frequency (rf) or direct current (dc) electrical fields. Other means of creating an activated source of atomic hydrogen and carbon species are also possible, e.g., using hot filaments of tungsten or tantalum heated to above 2,000° C., an rf or dc plasma torch or jet, or a combustion flame.

The final step in making an electron field emitting device as shown in block E of FIG. 1 is forming an electrode used to excite emission adjacent the diamond layer. Advantageously, this electrode is a high density aperture gate structure such as described in applicants' co-pending patent application Ser. No. 08/548,720. The combination of ultra-fine diamond emitters with a high density gate aperture structure is particularly desirable with submicron emitters. It is possible to achieve such a high density gate aperture structure by utilizing micron or submicron sized particle masks. After the ultra-fine diamond particle emitters are adhered to the conductive substrate surface and activated by hydrogen plasma, mask particles (metal, ceramic or plastic particles typically having maximum dimensions less than 5 $\mu$m) are applied to the diamond emitter surface as by spraying or sprinkling. A dielectric film layer such as $SiO_2$ or glass is deposited over the mask particles as by evaporation or sputtering. A conductive layer such as Cu or Cr is deposited on the dielectric. Because of the shadow effect, the emitter areas underneath each mask particle have no dielectric film. The mask particles are then easily brushed or blown away, leaving a gate electrode having a high density of apertures.

For display applications, emitter material (the cold cathode) in each pixel of the display desirably consists of multiple emitters for the purpose, among others, of averaging out the emission characteristics and ensuring uniformity in display quality. Because of the ultra-fine nature of the diamond particulates, the emitter provides many emitting points, typically more than $10^4$ emitting tips per pixel of 100 $\mu$m×100 $\mu$m, assuming 10% area coverage and 10% activated emitters from 100 nm sized diamond particles. Advantageously, the emitter density in the invention is at least $1/\mu m^2$, more advantageously at least $5/\mu m^2$ and even more advantageously at least $20/\mu m^2$. Since efficient electron emission at low applied voltages is typically achieved by the presence of accelerating gate electrode in close proximity (typically about 1 micron distance), it is useful to have multiple gate apertures over a given emitter area to maximally utilize the capability of multiple emitters. It is also desirable to have fine-scale, micron-sized structure with as many gate apertures as possible for maximum emission efficiency.

The presence of large amounts of non-diamond phases such as graphite or amorphous material is undesirable, because such phases are prone to disintegration during emitter operation and are therefore often deposited on other parts of the display as soot or particulates. Although the exact amount of the graphite or amorphous impurities in these ultra-fine diamond particles are not known, the low voltage emitting diamond particles in the present invention have a predominantly diamond structure, advantageously with less than 10 volume percent of graphite or amorphous carbon phases within 5 nm of the surface, more advantageously less than 2 volume percent and even more advantageously less than 1 volume percent. This predominantly diamond composition is consistent with the fact that graphite or amorphous carbon is generally etched away by the hydrogen plasma processing of the invention. The pre-existing graphitic or amorphous carbon regions in the particles would be expected to be preferentially etched away, particularly at the surfaces, where the electrons are emitted.

Figure 5:
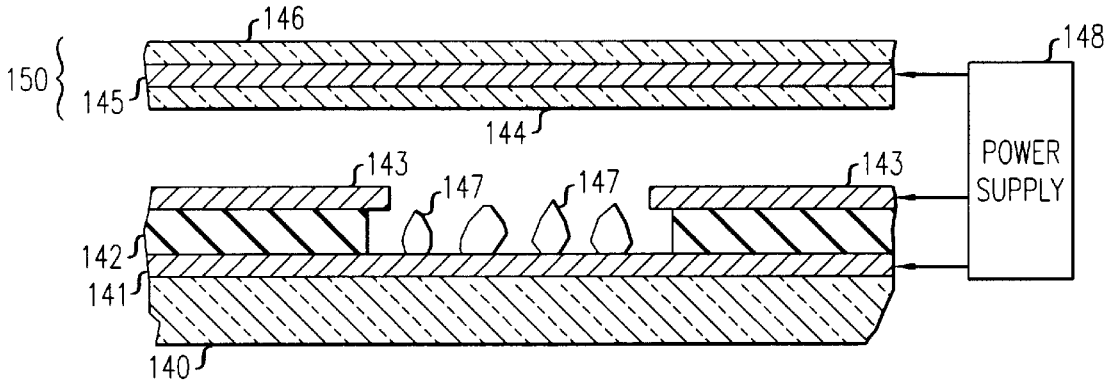
FIG. 5 is a schematic diagram of a field emission flat panel display device employing diamond field emitters.

A significant use of the low voltage emitters of the invention is in the fabrication of field emission devices such as electron emission flat panel displays. FIG. 5 is a schematic cross section of a flat panel display using low voltage particulate emitters. The display contains a cathode 141 deposited on a substrate 140, the cathode 141 containing a plurality of low voltage particulate emitters 147. An anode 150 is disposed in spaced relation from the emitters within a vacuum seal. The anode 150 contains an anode conductor 145 (typically a transparent conductor such as indium-tin-oxide) formed on a transparent insulating substrate 146. A phosphor layer 144 is attached to the anode conductor, and the entire anode 150 is typically mounted on support pillars (not shown). Between the cathode 140 and the anode 150, and closely spaced from the emitters, is a perforated conductive gate layer 143. Typically, the gate layer 143 is spaced from the cathode 141 by a thin insulating layer 142. In operation, the space between the anode 150 and the emitters 147 is sealed and evacuated, and voltage is applied by power supply 148. The field-emitted electrons from electron emitters 147 on each pixel are accelerated by the gate electrode 143, and move toward the anode conductive layer 145. As the accelerated electrons hit the phosphor layer 144, a display image is generated.

The low field diamond emitters of the invention are useful not only in flat panel displays but also as a cold cathode in a wide variety of other field emission devices, including x-y matrix addressable electron sources, electron guns for electron beam lithography, microwave power amplifiers, ion guns, microscopes, photocopiers and video cameras. The nanometer sizes of diamond are capable of being extended to micron sizes if suitable methods are found to impart them with sufficient conductivity and emissive surfaces.

EXAMPLE

Ultrafine diamond particles with an average size of 50–100 nm were obtained commercially from Dupont Company, under the product name Mypolex. The particles were suspended in an aqueous solution with ammonia acetate added as a surfactant to avoid agglomeration. The particles were applied onto n-type silicon samples (having a resistivity of 1 ohm-cm) as a thin film by spraying, brushing, or droplet-spreading. The film thickness was about 0.75 $\mu$m. After drying at room temperature, the samples were loaded into a microwave plasma chamber for surface treatment. The plasma was pure hydrogen, and the plasma chamber was operated at a microwave power of 1 kW and a total pressure of 20 Torr. The substrate temperature was 700° C., and the plasma exposure was performed for 60 minutes.

After the plasma treatment, some of the samples were further subjected to a diamond overcoating process in the same plasma chamber, using methane gas. The plasma chamber was operated at an input power of 1 kW, a pressure of 25 Torr, a substrate temperature of 700° C., and a methane volumetric concentration of 3%, for 30 minutes. The overcoating thickness was about 30 nm.

The field emission properties were measured in a vacuum chamber with a $10^{-8}$ Torr base pressure, at room temperature. A voltage of up to 2 kV was applied to a spherically-tipped molybdenum anode probe (radius of curvature about 1 mm) to collect electrons emitted from the cathode diamond emitter surface. A precision step controller (3.3 $\mu$m step size) was used to control the movement of the probe toward the cathode, and the emission current-voltage characteristics were measured as a function of the anode-cathode distance. Capacitance was also measured as a function of anode probe position to better determine the anode-cathode distance.

Figure 6:
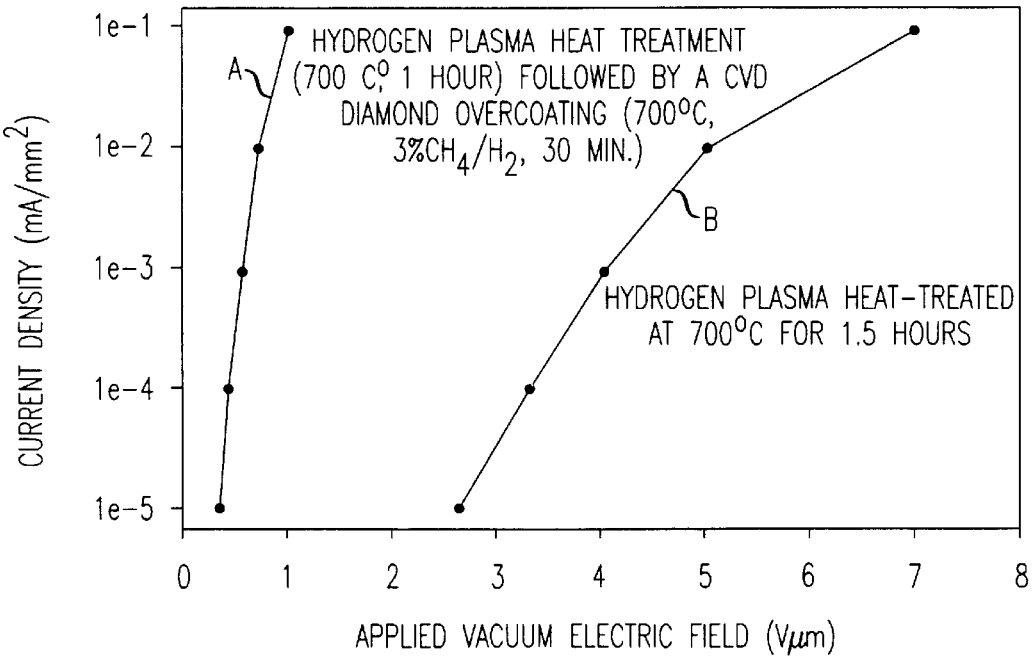
FIG. 6 shows experimentally measured curves of current density vs. applied field for ultra-fine diamond layers with and without the diamond overcoating of the invention.

FIG. 6 compares measured emission data (current density vs. applied field) for samples prepared without overcoating (curve A) and with the diamond overcoating (curve B). For emitters without the overcoating, the fields required to yield an emission current density of 0.1 mA/mm$^2$ are typically below 12 V/$\mu$m. Diamond particles emitters with the thin diamond overcoating show significantly improved emission properties with the emission threshold field range shifted downward by a factor of 2.5 to 4. With the overcoated samples, the fields required for an emission current density of 0.1 mA/mm$^2$ are generally below 3 V/$\mu$m, and reach as low as 0.2 V/$\mu$m.

Particle emitters with the overcoating also show the capability of producing higher emission current without breakdown (see Table I, which reflects measured values for a variety of samples). The maximum current densities for the overcoated emitters are 2–3 times higher than the emitters without overcoating. As discussed previously, it is believed that the higher current densities are due to more uniform surface structure and higher electrical conductivity of the overcoated emitters, the uniformity and higher conductivity resulting in higher emission site densities and improved emission uniformity.

TABLE I

| Samples (on n-type Si substrates) | Threshold field (for 0.1 mA/mm$^2$) (V/$\mu$m) | Maximum current density achieved before breakdown occurs (mA/mm$^2$) |
|---|---|---|
| untreated particles | electric arc and surface damage | — |
| heat-treated in $H_2$ plasma | 0.5–1.2 | 0.10–0.15 |
| heat-treated in $H_2$ plasma, followed by diamond overcoating in $H_2$ plasma with C-containing material | 0.2–3 | 0.3 |

In addition, the resistivity of the samples with and without the diamond overcoating was measured by a standard 4-point probe technique. The resistivity of uncoated diamond particle emitter structures ranged from $5\times10^6$ to $8\times10^7$ ohm-cm, while resistivity of emitter structures containing the diamond overcoating was about $1\times10^6$ ohm-cm. The improved resistivity appears to be due to the overcoating's effect of enhancing the bonding between the diamond particles.

What is claimed is:

1. A method for making an electron field emission device, comprising the steps of:

providing a substrate;

adhering to the substrate diamond particles having maximum dimensions in the range 5 to 10,000 nm;

exposing the diamond particles to a plasma containing hydrogen;

applying a conformal diamond overcoating to the diamond particles; and disposing an electrode adjacent to the diamond particles.

2. The method of claim 1 wherein the particles have maximum dimensions in the range 10 to 1,000 nm.

3. The method of claim 1, wherein the particles are exposed to the plasma at a temperature greater than 300° C.

4. The method of claim 3, wherein the particles are exposed to the plasma at a temperature in excess of 500° C.

5. The method of claim 1, wherein the diamond particles are adhered to the substrate prior to the step of exposing the particles to the plasma.

6. The method of claim 1, wherein the diamond particles are exposed to the plasma prior to the step of adhering the particles to the substrate.

7. The method of claim 1, wherein the diamond particles are adhered to the substrate by coating the substrate with a liquid suspension containing the diamond particles.

8. The method of claim 1, wherein the diamond particles are adhered to the substrate by coating the substrate with a slurry containing the diamond particles.

9. The method of claim 1, further comprising the step of applying a conductive layer to the substrate.

10. The method of claim 3, wherein the diamonds are exposed to the plasma for a period exceeding 30 minutes.

11. The method of claim 3, wherein the diamonds are exposed to the plasma for a time sufficient to produce a device having an electron emission current density of at least 0.1 $mA/mm^2$ at field strength below 3 V/$\mu$m.

12. The method of claim 1, wherein the substrate has a surface resistant to etching by hydrogen plasma.

13. The method of claim 1, wherein the diamond particles are adhered to the substrate in a single layer with 1% to 90% coverage of the surface of the substrate.

14. The method of claim 1, wherein the conformal overcoating has a thickness ranging from about 1 to about 50 nm.

15. The method of claim 1, wherein the conformal overcoating has a thickness less than 30 nm.

16. The method of claim 1, wherein the conformal overcoating is applied by treating the diamond particles in a plasma comprising hydrogen and a carbon-containing compound.

17. The method of claim 16, wherein the particles are treated at a temperature greater than 300° C.

18. The method of claim 16, wherein the carbon-containing compound is methane.

19. An electron field emission device comprising:

an emitter structure comprising a substrate having a conductive surface region, a plurality of diamond particles having maximum dimensions in the range 5 to 10,000 nm adhered to the surface region, and a conformal diamond overcoating on the particles, wherein the emission device exhibits an electron emission current density of at least 0.1 $mA/mm^2$ at a field strength below 12V/$\mu$m.

20. The device of claim 19, wherein the emitter structure exhibits a threshold field, at an electron emission current density of 0.1 $mA/mm^2$, at least 20% lower than an identical emitter structure without the conformal diamond overcoating.

21. The device of claim 20, wherein the emitter structure exhibits a threshold field at least 50% lower than an identical emitter structure without the conformal diamond overcoating.

22. The device of claim 19, wherein the emitter structure exhibits an emission current density at least 30% higher than an identical emitter structure without the conformal diamond overcoating at a field strength below 12V/$\mu$m.

23. The device of claim 22, wherein the emitter structure exhibits an emission current density at least 100% higher than an identical emitter structure without the conformal diamond overcoating.

24. The device of claim 19, wherein the electrical conductivity of the emitter structure is at least 20% higher than an identical emitter structure without the conformal diamond overcoating.

25. The device of claim 24, wherein the electrical conductivity is at least 50% higher than an identical emitter structure without the conformal diamond overcoating.

26. The device of claim 19, wherein the diamond overcoating has a thickness of about 1 to about 50 nm.

27. The device of claim 19, wherein the diamond overcoating has a thickness of less than 30 nm.

* * * * *